US006237158B1

(12) United States Patent
Barbara

(10) Patent No.: US 6,237,158 B1
(45) Date of Patent: May 29, 2001

(54) SOCK CLIP ASSEMBLY

(76) Inventor: Lori A. Barbara, 16311 Missionary Ridge, Baton Rouge, LA (US) 70817

( * ) Notice: Subject to any disclaimer, the term of this patent is extended or adjusted under 35 U.S.C. 154(b) by 0 days.

(21) Appl. No.: 09/526,589

(22) Filed: Mar. 16, 2000

(51) Int. Cl.[7] ..... A41B 11/00
(52) U.S. Cl. ..... 2/239; 24/DIG. 29
(58) Field of Search ..... 2/239, 241, 336, 2/244, 245, 60, 390; 24/DIG. 29, 390, 702, 576; 403/351, 311

(56) References Cited

U.S. PATENT DOCUMENTS

| | | | | |
|---|---|---|---|---|
| 2,663,877 | * | 12/1953 | Bohman | 2/239 |
| 3,414,944 | * | 12/1968 | Rabinowitz | 24/81 |
| 3,918,131 | * | 11/1975 | Ausnit | 24/201 |
| 4,058,853 | * | 11/1977 | Boxer et al. | 2/239 |
| 4,975,986 | * | 12/1990 | Strongwater | 2/160 |
| 5,038,413 | | 8/1991 | Ursino . | |
| 5,321,855 | * | 6/1994 | Ciuffo | 2/239 |
| 5,325,542 | * | 7/1994 | Lenerville | 2/244 |
| 5,337,495 | * | 8/1994 | Pippins | 37/453 |
| 5,340,335 | * | 8/1994 | Haun | 439/783 |
| 5,357,660 | | 10/1994 | Smith . | |
| 5,367,809 | * | 11/1994 | Ross | 40/668 |
| 5,450,658 | * | 9/1995 | Hicks | 24/303 |
| 5,579,541 | * | 12/1996 | Christy et al. | 2/239 |
| 5,699,557 | * | 12/1997 | Johnson | 2/239 |
| 5,740,558 | | 4/1998 | Messman . | |
| 5,918,318 | * | 7/1999 | Jones | 2/239 |
| 5,970,524 | * | 10/1999 | Becker et al. | 2/239 |
| 5,974,590 | * | 11/1999 | Stubbs | 2/239 |
| 6,032,294 | * | 3/2000 | Dean | 2/239 |
| 6,092,241 | * | 7/2000 | Bellet | 2/239 |

* cited by examiner

*Primary Examiner*—John J. Calvert
*Assistant Examiner*—Alissa L. Hoey
(74) *Attorney, Agent, or Firm*—Kenneth L Tolar

(57) ABSTRACT

A clip assembly for joining two matching socks to prevent the matching socks from being separated when laundered or stored includes a pair of panels each of which are attached to the exterior surface of a sock. The panels include mating tongues and grooves allowing the panels to be quickly and conveniently joined by sliding the tongues on each panel into the grooves on the other. The assembly also includes an ornament display panel having tongues and grooves on an inwardly facing side for interengaging the tongues and grooves on either panel allowing a user to display ornaments on the socks while the socks are being worn.

10 Claims, 1 Drawing Sheet

SOCK CLIP ASSEMBLY

BACKGROUND OF THE INVENTION

The present invention relates to socks, and more particularly, a clip assembly for joining a matching pair of socks.

DESCRIPTION OF THE PRIOR ART

Matching pairs of socks are often separated when laundered or stored. Furthermore, matching multiple pairs of socks after laundering can be extremely cumbersome and difficult since many socks have a similar appearance. Various fasteners for joining matching socks have been heretofore designed. For example, U.S. Pat. No. 5,740,558 issued to Messman discloses a device for joining socks including a flexible strip sewn to each of two matching socks. Each strip includes a mating snap-type fastener for joining the strips, and thus the socks, together.

U.S. Pat. No. 5,357,660 issued to Smith relates to a pair of sock clamp assemblies, each of which is clamped to a sock. One clamp includes a flange while the other includes a mating receptacle allowing the two clamps to be joined.

U.S. Pat. No. 5,038,413 issued to Ursino discloses a sock fastening device including a pair of fasteners each of which is attached to a sock. The fasteners include mating snap members for securing the fasteners together.

Although various devices for joining matching pairs of socks together exist, each include snap-type fasteners that are cumbersome to join and are susceptible to wear. Furthermore, snap type fasteners typically provide a tenuous attachment that can be detached with minimal force. The present invention provides sock clips that are securable with a convenient and durable tongue and groove attachment means.

SUMMARY OF THE INVENTION

The present invention relates to a sock clip assembly for joining a matching pair of socks. The assembly includes a panel attached to each sock, preferably near the ankle portion. Each panel includes a plurality of wedge-shaped tongues on an outwardly facing side thereof with similarly shaped grooves formed therebetween. Accordingly, the two panels may be joined by sliding the tongues on one of the panels into the grooves on the other panel. An ornament display panel can be similarly attached to either sock panel for displaying jewelry items and similar ornaments while the socks are being worn. It is therefore an object of the present invention to provide a sock clip for minimizing loss or separation of mating socks.

It is another object of the present invention to provide a sock clip that conveniently and securely joins a mating pair of socks.

It is yet another object of the present invention to provide a sock clip that can alternatively display jewelry items and similar ornaments while the socks are being worn. Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
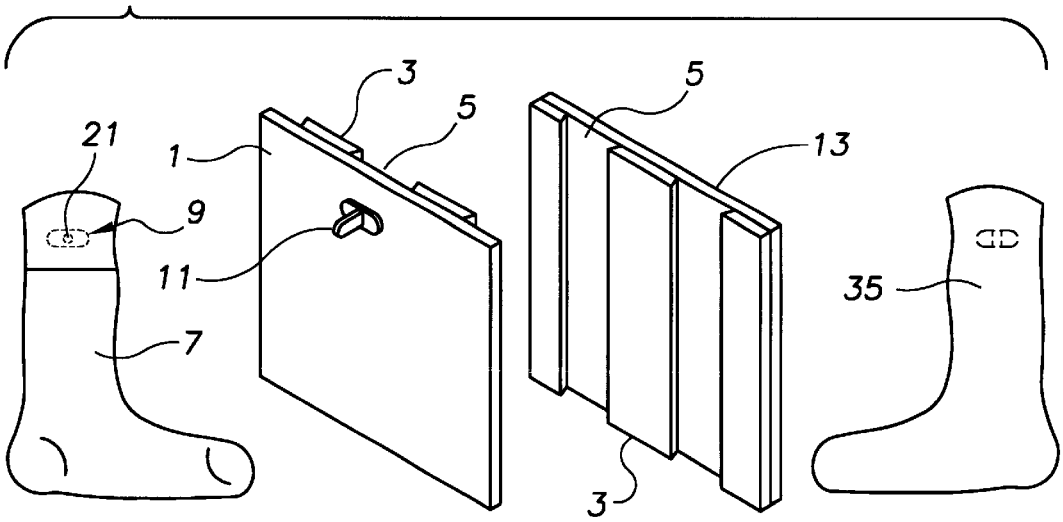
FIG. 1 is a perspective view of a pair of sock panels comprising the clip assembly and a corresponding sock offset therefrom.
Figure 2:
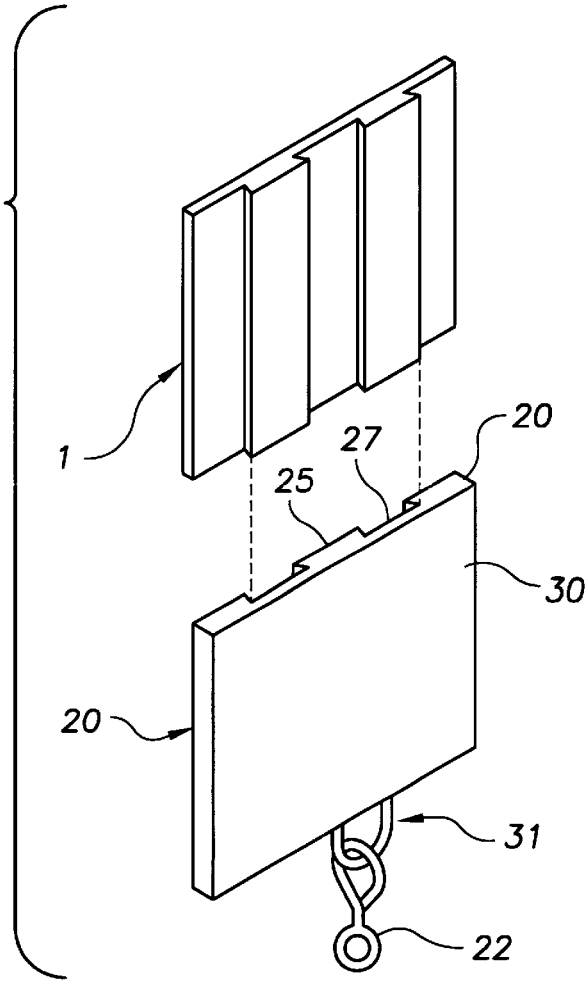
FIG. 2 is a perspective view of a jewelry display panel and a mating sock panel.

Referring now to FIGS. 1 and 2, the present invention relates to a sock clip assembly for joining two matching socks. The assembly includes a first panel I having an inwardly facing side and an outwardly facing side. On the outwardly facing side are two or more wedge-shaped longitudinal tongues 3 forming wedge-shaped grooves 5 therebetween. The inwardly facing side of the first panel is secured to the exterior surface of a sock 7, preferably near the ankle portion, using any one of a variety of means such as stitching, adhesives or similar conventional methods.

In addition, the panel may be secured to the sock using a fastening means that is often found on ornamental brooches and tie clips. As depicted in FIG. 1, a small fastening element 9 having a receptacle 21 therein is placed against the interior surface of the sock. An elongated pin 11 extends from the inwardly facing side of each panel for piercing the sock from the exterior surface whereby the sock is disposed between the fastening element and the panel. Once the pin completely penetrates the sock, it is inserted into the receptacle on the fastening element thereby fastening the panel to the sock.

The sock clip assembly also includes a second panel 13 fastened to a second, matching sock 35 using one of the means described above. The second panel includes substantially wedge-shaped tongues and grooves similar to those on the first panel. The tongue and grooves on one panel are alternately positioned and offset relative to the tongues and grooves on the other panel. Accordingly, the tongues on one panel can be interrelated with the grooves on the other panel while maintaining the panels in perfect alignment. As is now apparent, the first sock can be easily attached to a second matching sock by sliding the elongated tongues on each of the panels into the corresponding grooves on the other.

The assembly also includes a pair of jewelry display panels 20 for displaying jewelry items 22 and similar ornaments on the socks while the socks are being worn. Each jewelry display panel includes an inwardly facing side and an outwardly facing side. On the inwardly facing side are a plurality of tongues 25 and grooves 27 positioned to interengage the tongues and grooves on either sock panel. The outwardly facing side 30 of each jewelry display panel is smooth and planar. Depending from the lower edge of each jewelry display panel is a loop 31 to which a jewelry item or similar ornament can be attached.

Both the sock panels and jewelry panels are preferably constructed with a rigid, but somewhat flexible material, such as rubber or a similar equivalent. The fastening element is preferably constructed with a soft rubber or similar material to minimize discomfort to the wearer. Although wedge-shaped tongues and grooves are shown and described, any other suitable shape may also be used. Also, the tongues and grooves may be horizontally or obliquely positioned and the number may be varied, if desired. In addition, although the sock and jewelry display panels are depicted as rectangular, any other shape will suffice. As will be readily apparent to those skilled in the art the size, shape and materials of construction of the various components included in the above described invention may be varied without departing from the spirit thereof.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A sock clip assembly for joining two matching socks, said clip comprising:

a first panel attached to a first sock, said first panel having an outwardly facing side with a plurality of spaced tongues thereon, said tongues forming grooves therebetween;

a second panel attached to a second sock, said second panel having an outwardly facing side with a plurality of spaced tongues thereon, said tongues forming grooves therebetween, said tongues and grooves on said first panel positioned and configured to slidably interengage said tongues and grooves on said second panel.

2. A sock clip according to claim 1 wherein said tongues and grooves are substantially wedge-shaped.

3. A sock clip according to claim 1 further comprising an ornament display panel, said panel having an inwardly facing side with a plurality of spaced tongues thereon, said tongues forming grooves therebetween, said tongues and grooves positioned and configured to slidably interengage said tongues and grooves on either of said first and second panels;

means for attaching an ornament to said ornament display panel.

4. A sock clip according to claim 3 wherein said means for attaching an ornament to said ornament display panel comprises a loop depending from a lower edge of said jewelry display panel.

5. A sock clip according to claim 3 wherein said ornament display panel includes a smooth, planar outwardly facing side.

6. In combination with a pair of matching socks having an exterior surface, a clip assembly for joining said socks, said clip assembly comprising:

a first panel attached to one of said socks, said first panel having an outwardly facing side with a plurality of spaced tongues thereon, said tongues forming grooves therebetween;

a second panel attached to other of said pair of matching socks, said second panel having an outwardly facing side with a plurality of spaced tongues thereon, said tongues forming grooves therebetween, said tongues and grooves on said first panel positioned and configured to slidably interengage said tongues and grooves on said second panel whereby said panels can be conveniently attached to join said socks.

7. A sock clip according to claim 6 wherein said tongues and grooves are substantially wedge-shaped.

8. A sock clip according to claim 6 further comprising an ornament display panel, said panel having an inwardly facing side with a plurality of spaced tongues thereon, said tongues forming grooves therebetween, said tongues and grooves positioned and configured to slidably interengage said tongues and grooves on either of said first and second panels;

means for attaching an ornament to said ornament display panel.

9. A sock clip according to claim 8 wherein said means for attaching an ornament to said ornament display panel comprises a loop depending from a lower edge of said jewelry display panel.

10. A sock clip according to claim 9 wherein said ornament display panel includes a smooth, planar outwardly facing side.

* * * * *